US008882188B2

(12) United States Patent
Jin

(10) Patent No.: US 8,882,188 B2
(45) Date of Patent: Nov. 11, 2014

(54) FOLDING CHAIR

(76) Inventor: Ki Ho Jin, Rongshen New (CN)

( * ) Notice: Subject to any disclaimer, the term of this patent is extended or adjusted under 35 U.S.C. 154(b) by 112 days.

(21) Appl. No.: 13/604,978

(22) Filed: Sep. 6, 2012

(65) Prior Publication Data

US 2014/0049077 A1 Feb. 20, 2014

(51) Int. Cl.
*A47D 1/02* (2006.01)

(52) U.S. Cl.
USPC ..... 297/46; 297/53

(58) Field of Classification Search
CPC ..... A47C 4/14; A47C 4/24; A47C 5/06; A47C 1/02
USPC ..... 297/16.1, 29, 46, 48, 378.1, 47
See application file for complete search history.

(56) References Cited

U.S. PATENT DOCUMENTS

| | | | | | |
|---|---|---|---|---|---|
| 441,466 | A | * | 11/1890 | Bowen | 297/47 |
| 1,001,193 | A | * | 8/1911 | Fryman | 297/53 |
| 1,721,164 | A | * | 7/1929 | Newell et al. | 297/56 |
| 2,016,385 | A | * | 10/1935 | Molling et al. | 297/57 |
| 5,478,138 | A | | 12/1995 | Yu | |
| 5,730,489 | A | | 3/1998 | Eberle et al. | |
| 6,511,122 | B1 | | 1/2003 | Chen | |
| 7,017,986 | B2 | | 3/2006 | Degen et al. | |
| 7,080,877 | B1 | | 7/2006 | Tsai | |
| 7,784,861 | B1 | | 8/2010 | Deng | |
| 2003/0020303 | A1 | | 1/2003 | Chen | |
| 2008/0296936 | A1 | | 12/2008 | Tsonev et al. | |
| 2009/0261628 | A1 | | 10/2009 | Leng | |
| 2012/0319435 | A1 | * | 12/2012 | Choi | 297/51 |

FOREIGN PATENT DOCUMENTS

| | | | | |
|---|---|---|---|---|
| CA | 2792935 | A1 | * | 9/2011 |
| CA | 2789541 | A1 | | 2/2014 |
| CN | 86201132 | U | | 4/1987 |
| CN | 2046338 | U | | 10/1989 |
| CN | 2080784 | U | | 7/1991 |
| CN | 2096926 | U | | 2/1992 |
| CN | 2282367 | Y | | 5/1998 |
| CN | 200983993 | Y | | 12/2007 |
| CN | 201029624 | Y | | 3/2008 |

OTHER PUBLICATIONS

Canadian Intellectual Property Office; App. No. 2,789,541; Non-Final Office Action, dated Dec. 10, 2013.

* cited by examiner

*Primary Examiner* — David R Dunn
*Assistant Examiner* — Jody Giacoman
(74) *Attorney, Agent, or Firm* — John H. Choi

(57) ABSTRACT

A folding chair includes a front leg frame, a rear leg frame and a backrest frame pivotally coupled to a seat. Support braces are pivotally coupled to the backrest frame on one end and pivotally coupled to the front leg frame on an opposing end by sliding members that are slidably coupled to a corresponding slot formed on each side of the seat. In an open configuration the backrest frame is substantially upright and positioned substantially perpendicular to the seat, and each sliding member engages a rear end of a corresponding slot such that the front leg frame forms an X-shape with respect to the rear leg frame. The components are folded in one motion into a folded configuration in which each sliding member engages a front end of a corresponding slot while the backrest frame, seat, and front and rear leg frames are positioned co-planar to each other.

20 Claims, 8 Drawing Sheets

FOLDING CHAIR

CROSS REFERENCES TO RELATED APPLICATIONS

This application claims priority to and benefit of China Application No. 201220408693.4, filed on Aug. 17, 2012, which is incorporated by reference in its entirety.

BACKGROUND OF THE INVENTION

The present invention relates generally to chairs, and more specifically to a folding chair foldable into a compact state for convenient storage and transport.

Compared to other seating devices, folding chairs offer the advantages of being compact and lightweight. Generally, folding chairs are easier to store and transport than are non-folding chairs. Further, folding chairs may often be purchased at a lower cost than non-folding chairs.

Folding chairs are designed and manufactured in a variety of forms. Typically, however, a folding chair consists of a seat, a backrest, and foldable support structures, including front and rear legs. In an open configuration, the seat supports the weight of a person while the backrest provides support for the person's back, so the person may comfortably lean back while seated. In a folded configuration, the components fold together, often overlapping, for storage and/or transport.

In most conventional foldable chairs, the front legs extend upwardly to receive or form at least a portion of a backrest; the seat and the front legs are hinged together; and the seat is slidably connected with the rear legs through a connecting device. In an earlier version of this type of foldable chair, when folded, the seat is pivoted upwardly toward to the backrest so that the seat and backrest overlap, while the front legs and the rear legs abut against each other. In a newer version of this type of foldable chair, when folded, the seat is pivoted upwardly toward the backrest but the seat is positioned in a space beneath the backrest so that the seat and backrest are substantially co-planar. However, even with the improvement, the front legs and back legs overlap and cannot be collectively positioned co-planar with the backrest and seat. Moreover, the overall length of the chair cannot be reduced due to the front legs being integral to the backrest. Thus, problems with storage and transport, including the requirement of increased shelf space in retail stores and inefficient packaging for shipping, often arise because of the thickness as well as the overall length of the folded chair.

In an effort to solve the problems associated with conventional foldable chairs, an improved foldable chair that is foldable into a more compact configuration was developed, as shown in FIGS. 1-3. The foldable chair of the prior art includes a front leg frame 22', a rear leg frame 21' and a backrest frame 3' pivotally coupled to a seat 1'. The rear leg frame 21' is slidably coupled to a pair of spaced apart slots 11' on a bottom portion of the seat 1'. Each component is positioned such that in an open configuration, as shown in FIG. 1, the backrest frame 3' is supported by an upper portion of the front leg frame 22', and the rear leg frame 21' engages front ends of the slots 11' such that the front leg frame 22' forms an X-shape with respect to the rear leg frame 21'. To fold the chair, as shown in FIG. 2, the leg frames 21' and 22' are pivoted toward each other as the seat 1' is pivoted downward to overlap with the folded leg frames 21' and 22'. The backrest 4' is then pivoted toward the seat 1', such that the front leg frame 22', rear leg frame 21', backrest frame 3' and seat 1' are positioned substantially co-planar to each other, as shown in FIG. 3.

Even though the improved foldable chair of the prior art provides a more compact folded configuration, the folding procedure is inconvenient because the chair must be folded in two separate steps. It is further inconvenient to fold the chair because during the folding process the user must engage portions of the chair which are not easy to handle, e.g., the bottom portion of the backrest frame 32', which could pose safety issues.

What is needed, therefore, is a folding chair that is stable and secure when unfolded and in use, which is capable of safely folding in one continuous motion into a substantially flat, compact package with reduced length for more convenient transport and storage.

BRIEF SUMMARY OF THE INVENTION

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to a more detailed description that is presented later.

Briefly stated, the present invention in general provides a folding chair configurable into an open configuration and a folded configuration, the folding chair comprising: a seat comprising opposing top and bottom portions; a leg assembly comprising: a front leg frame having a pair of front legs spaced apart substantially parallel to each other and a rear leg frame having a pair of rear legs spaced apart substantially parallel to each other, the front and rear leg frames pivotally coupled to each other intermediate respective upper and lower ends such that in the open configuration the front leg frame forms an X-shape with respect to the rear leg frame and in the folded configuration the front and rear leg frames are substantially co-planar, the fronts legs pivotally coupled to the seat intermediate front and rear ends of the seat, the rear legs pivotally coupled to the seat proximate a front end of the seat; a backrest frame comprising a pair of spaced apart backrest support members substantially parallel to each other, the backrest frame separate and independent from the leg assembly, lower ends of each backrest support member pivotally coupled to the seat; and a pair of support braces, upper ends of each support brace pivotally coupled to a corresponding backrest support member and opposing lower ends of each support brace pivotally coupled to the seat.

In one aspect, the present invention provides a folding chair a seat comprising: opposing top and bottom portions, and a pair of opposing side portions extending substantially normal to and downward from the bottom portion, each side portion having an outer slot extending between a front end and a rear end of the seat; a leg assembly comprising: a front leg frame having a pair of front legs spaced apart substantially parallel to each other and a rear leg frame having a pair of rear legs spaced apart substantially parallel to each other, the adjacent front and rear legs pivotally coupled to each other intermediate respective upper and lower ends; a backrest frame comprising a pair of spaced apart backrest support members substantially parallel to each other, lower ends of each backrest support member pivotally coupled to a rear portion of the seat, a backrest connected to top portions of the backrest support members; and a pair of support braces, upper ends of each support brace pivotally coupled to a corresponding backrest support member and opposing lower ends of each support brace pivotally coupled to an upper end of a corresponding front leg by a sliding member, the sliding member extending through a corresponding outer slot such that the support brace and front leg are slidably engaged with the seat; wherein in the open configuration the backrest frame is substantially upright and positioned substantially perpendicular to the seat, and each sliding member engages a rear end of a corresponding outer slot such that the front leg frame forms an X-shape with respect to the rear leg frame, and wherein in a folded configuration the backrest pivots toward the seat simultaneously while the front and rear leg frames are pivoted toward each other to a substantially parallel arrangement, and each sliding member slides toward a front end of a corresponding outer slot such that the backrest, seat and front and rear leg frames are overlapped.

In another aspect, the present invention provides a folding chair comprising: a seat comprising: opposing top and bottom portions, and a pair of opposing side portions extending substantially normal to and downward from the bottom portion, each side portion having an outer slot extending between a front end and a rear end of the seat; a pair of guiding members each connected to the seat bottom portion adjacent each side portion, an inner slot extending between a front end and rear end of the guiding member, the inner slot and outer slot substantially aligned with each other; a front support member connected to the seat bottom portion proximate the seat front end, the front support member having a pair of rearwardly extending bracket members, each bracket member disposed proximate opposing ends of the front support member; a leg assembly comprising: a front leg frame having a pair of front legs spaced apart substantially parallel to each other and a rear leg frame having a pair of rear legs spaced apart substantially parallel to each other, the front leg frame having a width narrower than the rear leg frame such that each front leg is positioned between the opposing rear legs adjacent to a corresponding rear leg, the adjacent front and rear legs pivotally coupled to each other intermediate respective upper and lower ends, upper ends of each rear leg pivotally coupled to a corresponding bracket member of the front support member; a backrest frame comprising a pair of spaced apart backrest support members substantially parallel to each other, the backrest frame being separate and independent from the leg assembly, an upwardly extending backrest coupled to upper portions of the backrest support members, lower ends of each backrest support member pivotally coupled to a seat side portion; and a pair of support braces, upper ends of each support brace pivotally coupled to a corresponding backrest support member and opposing lower ends of each support brace pivotally coupled to an upper end of a corresponding front leg by a sliding member, the sliding member extending through corresponding inner and outer slots such that the support brace and front leg are slidably engaged with the seat; wherein in the open configuration the backrest is substantially upright and positioned substantially perpendicular to the seat, and each sliding member engages a rear end of a corresponding inner and outer slot such that the front leg frame forms an X-shape with respect to the rear leg frame, and wherein in the folded configuration each sliding member engages a front end of a corresponding aligned inner and outer slot, the backrest is pivoted toward and overlaps the seat, the front and rear leg frames are pivoted toward each other to a substantially parallel arrangement, and the lower end of the backrest and the rear end of the seat are pivoted toward lower portions of the front and rear leg frames such that the backrest, seat and leg frames are overlapped.

BRIEF DESCRIPTION OF THE DRAWINGS

To better understand the present invention, a more particular description of the invention will be rendered by reference to the appended drawings.

Figure 1:
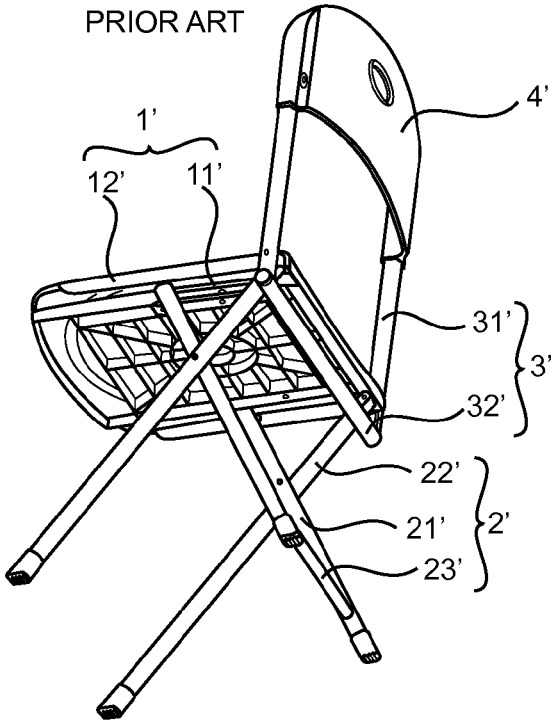
FIG. 1 is a bottom perspective view of a folding chair of the prior art in an open configuration.
Figure 2:
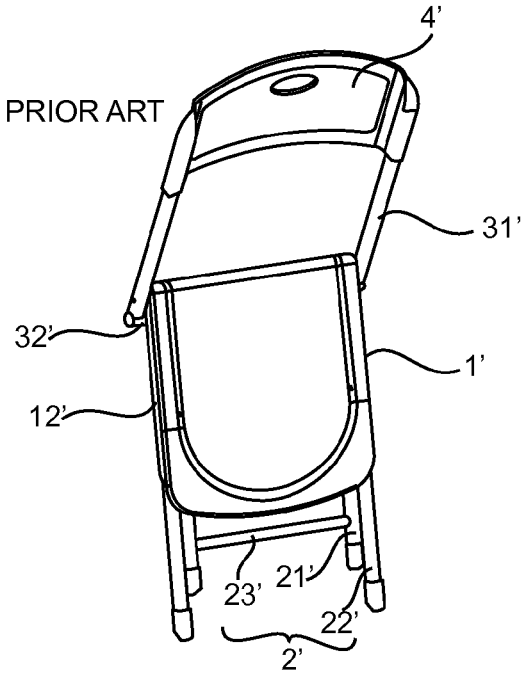
FIG. 2 is a front perspective view of the folding chair of FIG. 1 in a partially folded configuration.
Figure 3:
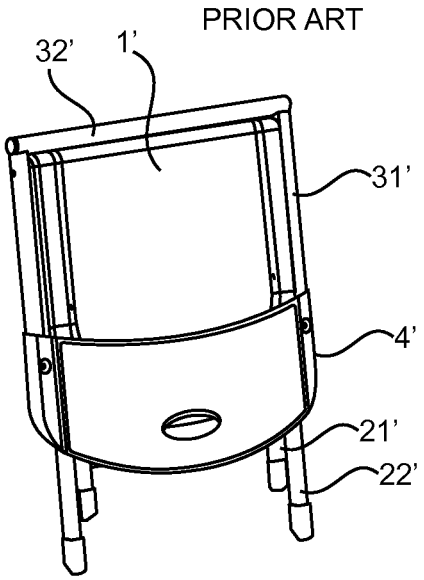
FIG. 3 is a front perspective view of the folding chair of FIG. 1 in a fully folded configuration.

To facilitate an understanding of the invention, identical reference numerals have been used, when appropriate, to designate the same or similar elements that are common to the figures. Further, unless stated otherwise, the features shown in the figures are not drawn to scale, but are shown for illustrative purposes only.

DETAILED DESCRIPTION

Certain terminology is used in the following description for convenience only and is not limiting. To assist in the description of the present invention, words such as "top," "bottom," "front," "rear," "back," "upper," "lower," "right" and "left" are used to describe the accompanying figures. Also, the article "a" is intended to include one or more items. Where only one item is intended, the term "one" or similar language is used. The terminology includes the words above specifically mentioned, derivatives thereof, and words of similar import.

Referring to FIGS. 4-13, a first embodiment of a folding chair 100 (FIGS. 4-8) and a second embodiment of a folding chair 200 (FIGS. 9-13) of the present invention are shown. The two embodiments are substantially identical structurally with a few exceptions. Therefore, structural components which are common to both embodiments are described by making reference to either set of figures.

First Embodiment

Figure 4:
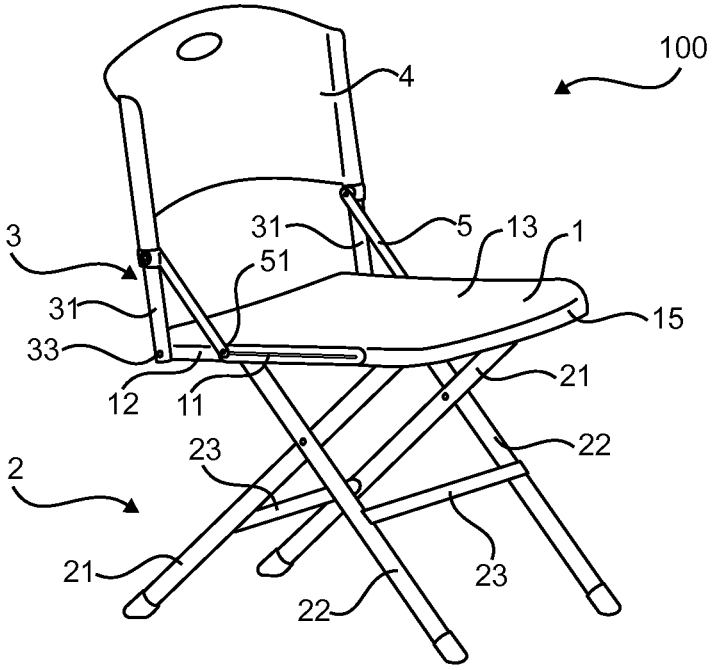
FIG. 4 is a front-side perspective view of a first embodiment of a folding chair of the present invention in an open configuration.
Figure 5:
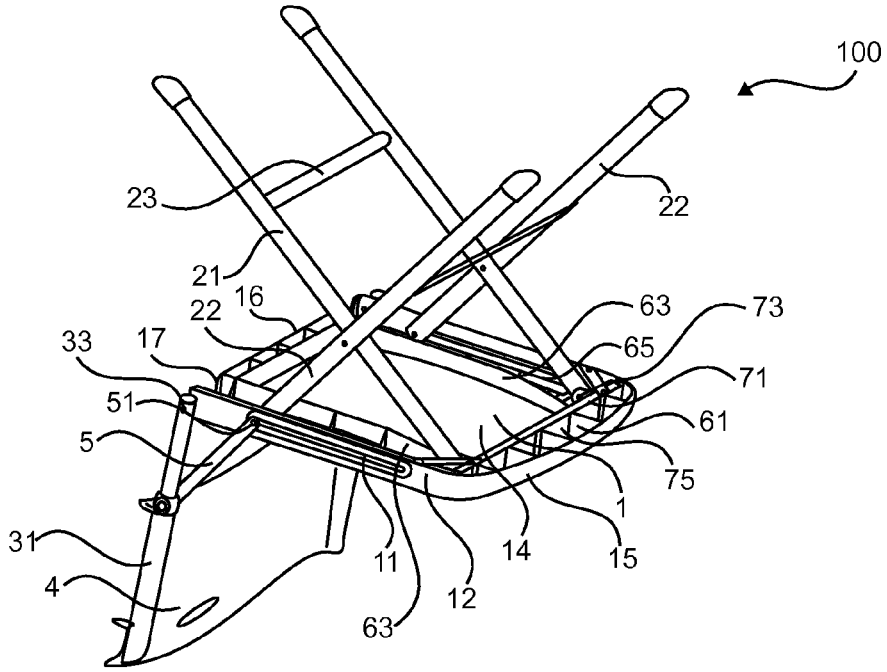
FIG. 5 is a bottom perspective view of the folding chair of FIG. 4 in an open configuration.
Figure 6:
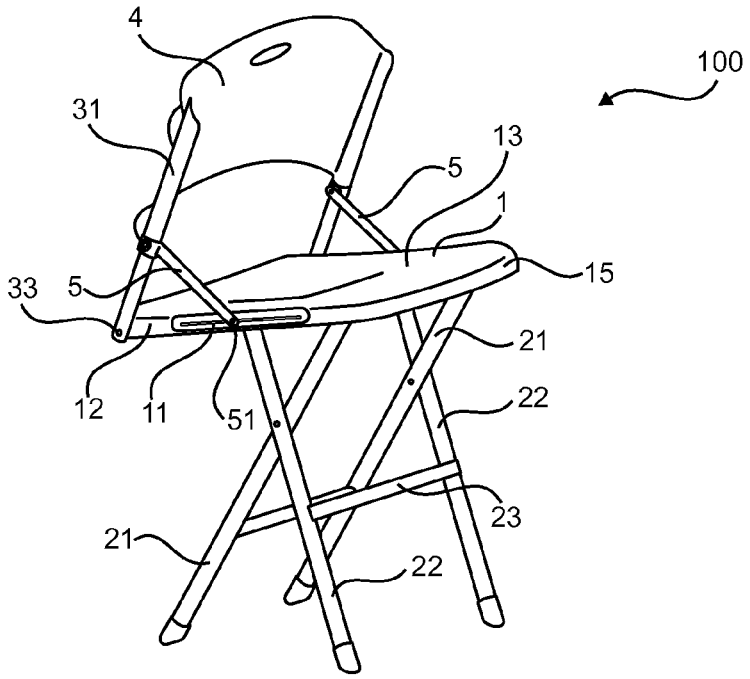
FIG. 6 is a front-side perspective view of the folding chair of FIG. 4 in a partially folded configuration.
Figure 7:
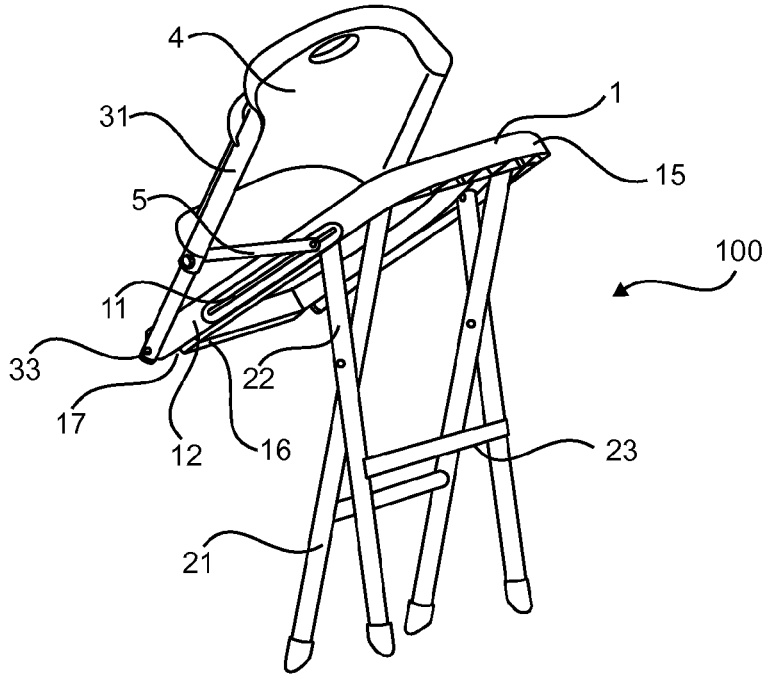
FIG. 7 is a front-side perspective view of the folding chair of FIG. 4 in another partially folded configuration.
Figure 8:
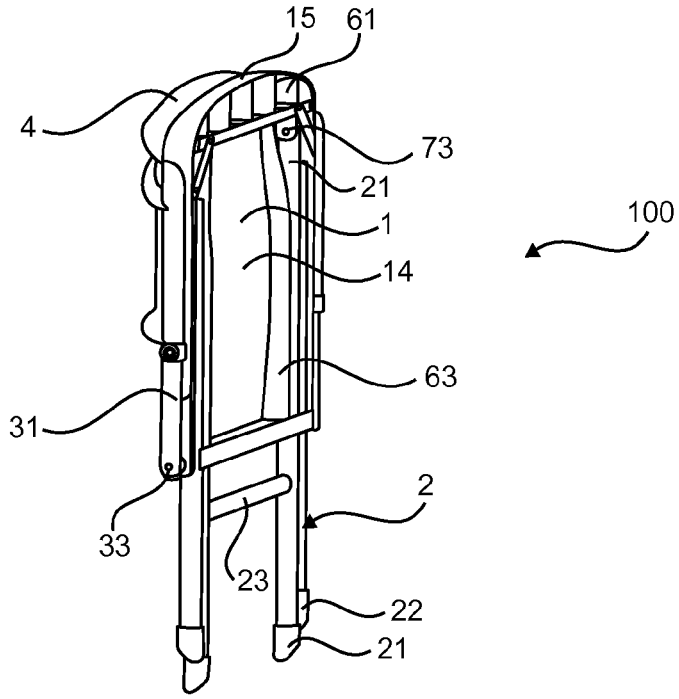
FIG. 8 is a front-side perspective view of the folding chair of FIG. 4 in a fully folded configuration.
Figure 9:
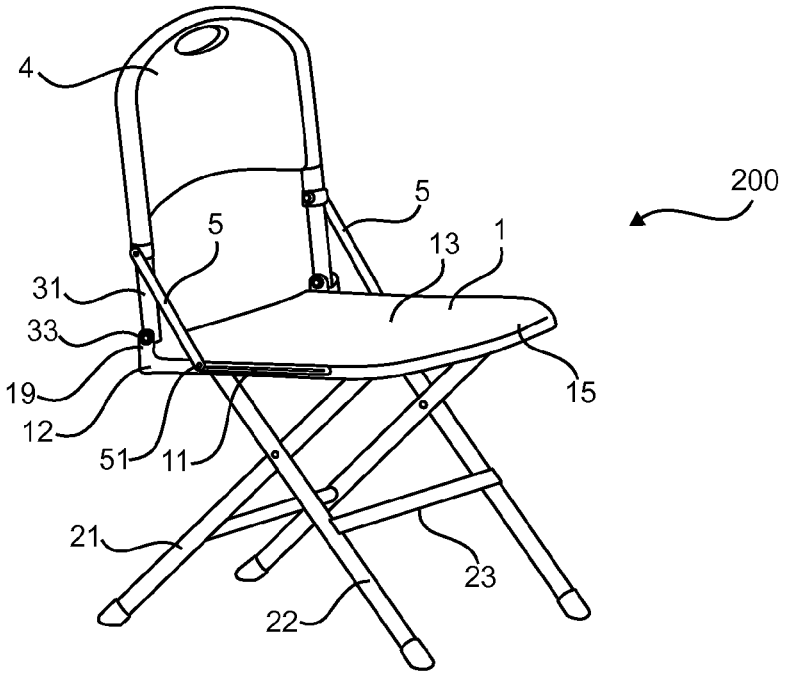
FIG. 9 is a front-side perspective view of a second embodiment of a folding chair of the present invention in an open configuration.
Figure 10:
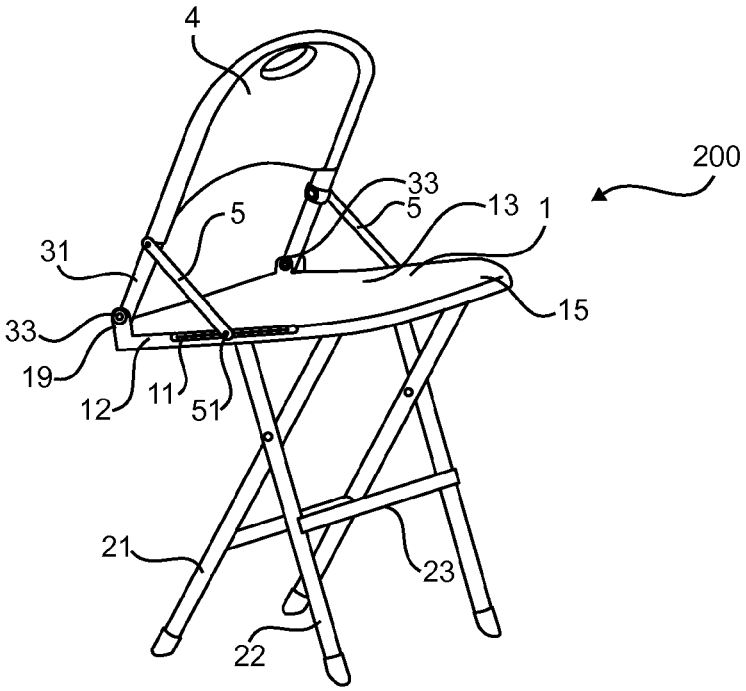
FIG. 10 is a front-side perspective view of the folding chair of FIG. 9 in a partially folded configuration.

Referring to FIGS. 4-8, a first embodiment of a folding chair 100 of the present invention is shown. The folding chair 100 is configurable into an open configuration, as shown in FIGS. 4 and 5, and a folded configuration, as shown in FIG. 8.

Referring to FIGS. 4-8, the folding chair 100 includes a seat 1 having opposing top and bottom portions 13, 14. In the preferred embodiment, the seat 1 is substantially rectangular and the top portion 13 is slightly concave to provide a comfortable seating surface for the user, but the seat top portion 13 could take on other shapes including but not limited to a flat configuration or multiple concave portions. It is also preferred that the seat 1 is light-weight and constructed of injection molded plastic but the seat 1 could also be constructed by blow molding. The seat 1 also includes and a pair of opposing side portions 12 extending from each side end of the top and bottom portions 13, 14; and a front portion 15 and an opposing rear portion 16 extending from a front end and a rear end, respectively, of the top and bottom portions 13, 14. Each of the side portions 12, front portion 15 and rear portion 16 extend substantially normal to and downward from the bottom portion 14. Each side portion 12 includes an elongated outer slot 11 extending between the front and rear ends of the seat 1. The rear portion 16 includes a pair of voids 17 disposed proximate each end of the rear portion 16, as shown in FIGS. 5 and 7. Each void 17 has a width substantially equal to the combined width of the front and rear legs 22, 21.

Figure 13:
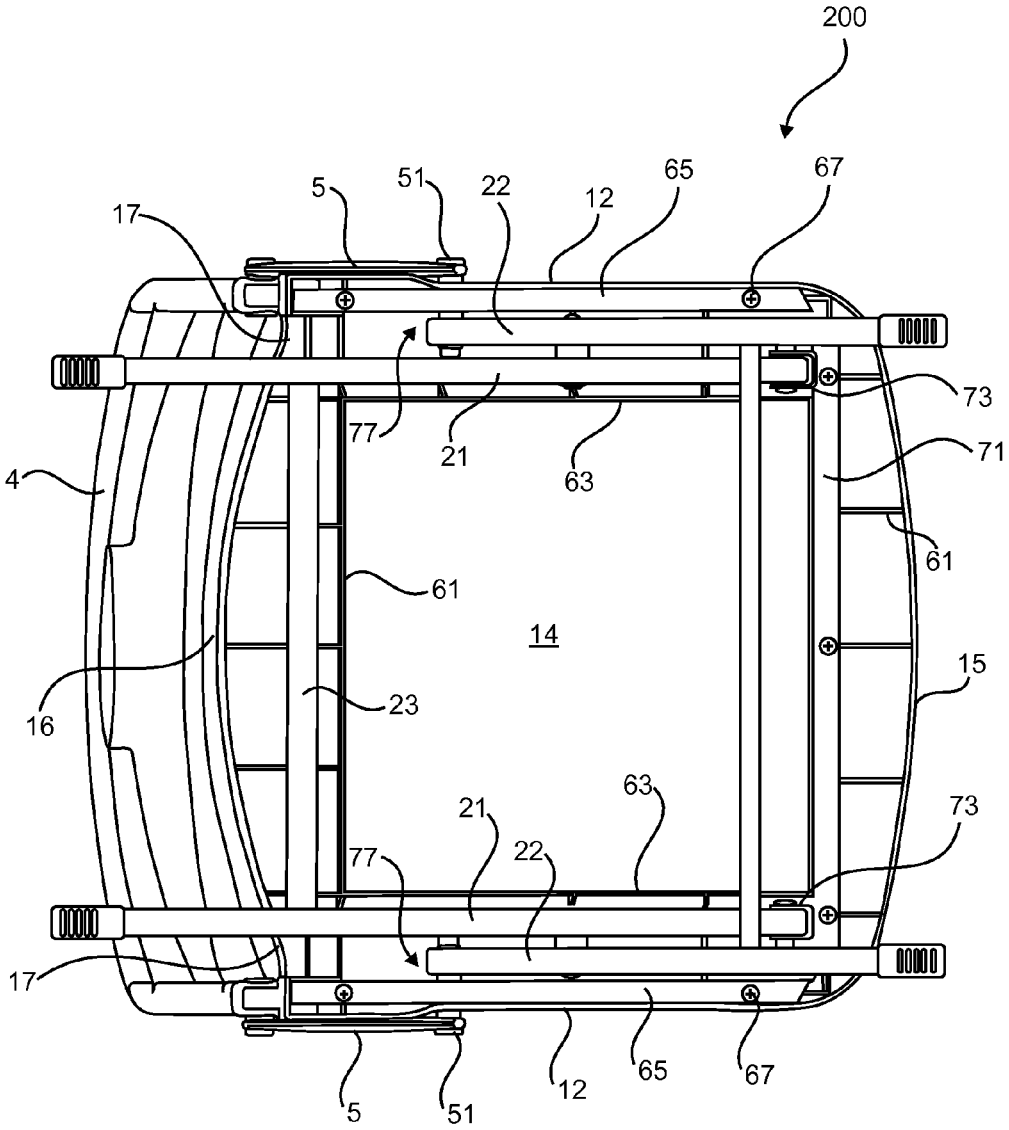
FIG. 13 is a bottom view of the folding chair of FIG. 9 in an open configuration.

Referring to FIGS. 5, 8 and 13, the bottom portion 14 of the seat 1 is shown. A plurality of reinforcement ridges 61 and integrally formed on the seat bottom portion 14 to provide additional strength to the seat 1. The reinforcement ridges 61 may include an additional pattern of ridges on a central area of the bottom portion 14 to ensure that the weight of the user is sufficiently supported. In this embodiment, the reinforcement ridges 61 also include opposing longitudinal ridges 63 extending between the front and rear ends of the seat 1, and spaced apart and substantially parallel to each side portion 12. Each longitudinal ridge 63 is positioned such that the rear end of the longitudinal ridge 63 culminates at an inner end of each void 17. Thus, a longitudinal outer channel 77 is formed adjacent the longitudinal ridge 63 extending proximate the seat front portion 15 through the void 17, as shown, e.g., in FIG. 13. The width of the outer channel 77 is such that adjacent front and rear legs 22, 21 could be housed therein in the folded configuration.

Referring again to FIGS. 5 and 13, a set of integrally formed fastener receiving members (not shown) extend downwardly from the seat bottom portion 14 adjacent to each side portion 12. Each set of fastener receiving members extend through a guiding member 65 which is fixed to the seat bottom portion 14 via fasteners, such as screws 67, extending through the fastener receiving members, as shown in FIG. 13. Each guiding member 65 includes an elongated inner slot 69 extending between the guiding member front end and rear end, as shown, e.g., in FIG. 12. Each inner slot 69 is aligned with a corresponding outer slot 11.

As shown in FIGS. 5 and 13, a transverse ridge 75 is integrally formed on the seat bottom portion 14 proximate and substantially parallel to the seat front portion 15. An additional set of integrally formed fastener receiving members (not shown) extend downwardly from the seat bottom portion 14 at intersection points of the transverse ridge 75 and reinforcement ridges 61. Each fastener receiving member extends through a front support member 71 which is fixed to the seat bottom portion 14 via fasteners, such as screws 67, extending through the fastener receiving members, as shown, e.g., in FIG. 13. The front support member 71 includes a pair of rearwardly extending U-shaped bracket members 73 which are connected to the front support member 71 proximate opposing ends by conventional welding methods. One skilled in the art will recognize that the bracket members 73 could take on other forms such as a single flange.

Referring to FIG. 4, the folding chair 100 includes a leg assembly 2 having a front leg frame and a rear leg frame. The front leg frame includes a pair of spaced apart front legs 22 in a substantially parallel arrangement. Similarly, the rear leg frame includes a pair of spaced apart rear legs 21 in a substantially parallel arrangement. The front and rear leg frames are pivotally coupled to each other intermediate upper and lower ends of each respective leg frame. The rear leg frame is narrower than the front leg frame such that outer sides of the rear leg frame are positioned on respective inner sides of the front leg frame. This allows the leg frames to pivot to a co-planar, side-by-side position, as shown in FIG. 8, when the folding chair 100 is in the folded configuration. In this embodiment, the rear legs 21 are connected by a transverse leg support member 23 on inner side portions of the respective rear legs 21, by conventional welding methods, to provide additional stability to the rear leg frame. The front legs 22 are also connected by another transverse leg support member 23 on front side portions of the respective front legs 22, by conventional welding methods, to provide additional stability to the front leg frame. The positioning of the transverse leg support member 23 of the front leg frame on the front side portion is to prevent the transverse leg support member 23 of the front legs 22 from interfering with the rear legs 21 when the chair is folded, as shown in FIG. 8. Referring to FIGS. 5 and 13, upper ends of the rear legs 21 are pivotally connected to corresponding bracket members 73, preferably by a nut and bolt combination.

Referring to FIGS. 4-8, the folding chair 100 also includes a backrest frame 3 having a pair of spaced apart backrest support members 31 in a substantially parallel arrangement. A backrest 4 is disposed on upper portions of each backrest support member 31, and in the preferred embodiment, a handle is integrally formed on an upper portion of the backrest 4 by way of an oversized aperture but other shapes and sized could be formed on the backrest to provide a handle. A handle could also be separately attached to the backrest by other means or the backrest could be constructed without a handle. Similar to the seat 1, it is preferred that the backrest 4 is light-weight and constructed by injection molded plastic but blow molding could be utilized as well. In the preferred embodiment, an inner portion of the backrest 4 between the backrest support members 31 are offset such that the inner portion of the backrest 4 is positioned behind the backrest support members 31. That is, the backrest support members 31 are co-planar while the backrest inner portion is positioned on a separate plane. The inner portion of the backrest 4 is concave to provide a comfortable back support for the user. However, the inner portion of the backrest 4 could also be flat or take on other shapes as well.

Referring again to FIGS. 4-8, in the preferred embodiment, lower ends of each backrest support member 31 are pivotally coupled to the rear ends of the opposing seat side portions 12, preferably by a nut and bolt combination 33. However, other fasteners such as a screw, rivet or the like could be used. An upper end of a support brace 5 is pivotally connected to the backrest support member 31 on an inner side intermediate the upper and lower ends thereto. Lower ends of each support brace 5 are pivotally coupled to an upper end of a corresponding front leg 22 by a sliding member 51. In the preferred embodiment, the sliding member 51 is a nut and bolt combination but other fasteners such as rivets or the like could be used. The sliding member 51 extends through corresponding inner and outer slots 69, 11 such that the support brace 5 and front leg 22 are slidably engaged with the seat 1. In the preferred embodiment, the width of the slots 69, 11 is slightly greater than the diameter of the sliding member 51 such that the sliding member 51 could travel through the sliding member 51 with minimal friction. However, the slots 69, 11 could be constructed such that the width of the elongated slots 69, 11 at a rear end is substantially similar to the diameter of the sliding member 51 and the slot width increases toward the front end of the elongated slots 69, 11. This would allow the sliding member 51 to lock into the slot rear end in the open configuration and slide freely toward the front end to a folded configuration. The presence of the slots 69, 11 on opposing sides of the seat 1 provides additional stability to both sides of the leg frame assembly 2 and further guides each front leg 22 to slide in concert with each other.

The frame of the folding chair 100, including the leg assembly 2, backrest frame 3, support brace 5, guiding members 65 and front support member 71 are preferably constructed of steel or steel alloy to provide strength while reducing material cost. The legs 21, 22 and backrest support members 31 are hollow and tubular while the guiding members 65 and front support member 71 are U-shaped to minimize weight and material cost. One of ordinary skill in the art will recognize that other materials such as aluminum could be used for the overall frame to further reduce the weight of the folding chair 100 without departing from the spirit and scope of the invention.

Referring to FIGS. 4 and 5, in the open configuration the backrest 4 is substantially upright and positioned substantially perpendicular to the seat 1. Each sliding member 51 engages a rear end of a corresponding inner and outer slot 69, 11 such that the front leg frame forms an X-shape with respect to the rear leg frame. In this configuration, the folding chair 100 is fixed and rigid to provide a secure and comfortable seating means for the user.

Referring to FIGS. 6-8, to fold the folding chair 100, the user engages the backrest 4 on one hand and the seat 1 on another hand, and pushes the backrest 4 and seat 1 toward each other. Each sliding member 51 moves toward the front end of the slots 69, 11; the front and rear leg frames are pivoted toward each other; and the lower end of the backrest support members 31 and the rear end of the seat 1 are pivoted toward lower portions of the front and rear leg frames, as shown in FIGS. 6 and 7. When fully folded in the folded configuration, as shown in FIG. 8, the sliding members 51 engage front ends of corresponding slots 69, 11; the front and rear legs 22, 21 are in a substantially parallel arrangement and positioned within the outer channels 77 of the seat bottom portion 14; and the backrest 4 overlaps with the seat 1 and front and rear legs 22, 21 such that the backrest support members 31, seat side portions 12 and legs 22, 21 are co-planar. Thus, the folding chair 100 is safely folded in one motion into a substantially flat, compact state with reduced length for more convenient transport and storage.

Second Embodiment

A second embodiment of a folding chair 200 of the present invention is shown in FIGS. 9-13. As mentioned above, the structure of the first and second embodiments 100, 200 are substantially identical with a few exceptions which will be described below. Thus, the structural components common to the two embodiments already described above with respect to the folding chair of the first embodiment 100 are incorporated by reference in this section. Furthermore, the folding procedure for the folding chair of the second embodiment 200 is substantially identical with the folding procedure described above, which is incorporated by reference in this section. However, the positioning of the structural components of the second embodiment 200 in the folded configuration varies slightly and will be described below.

Figure 11:
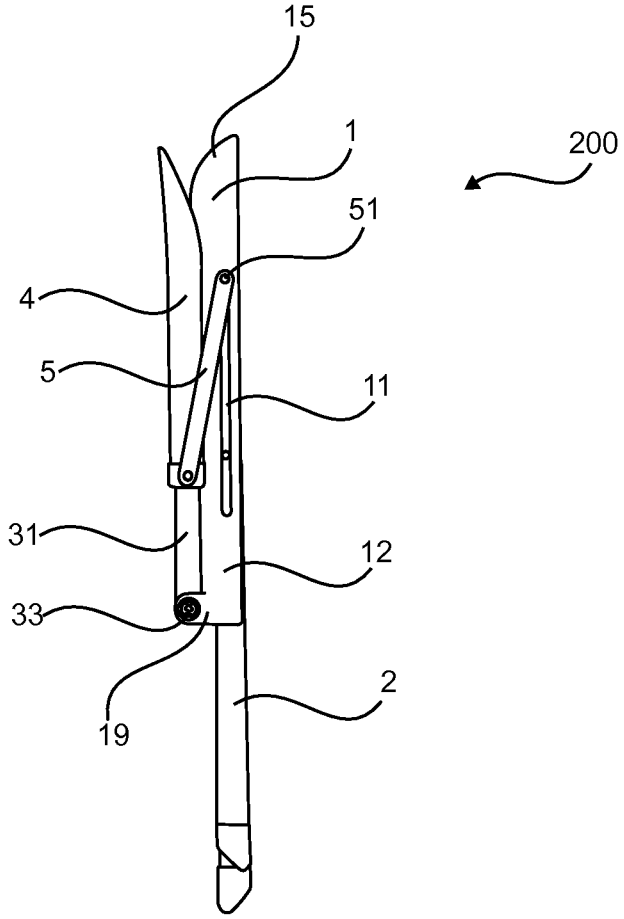
FIG. 11 is a side view of the folding chair of FIG. 9 in a fully folded configuration.
Figure 12:
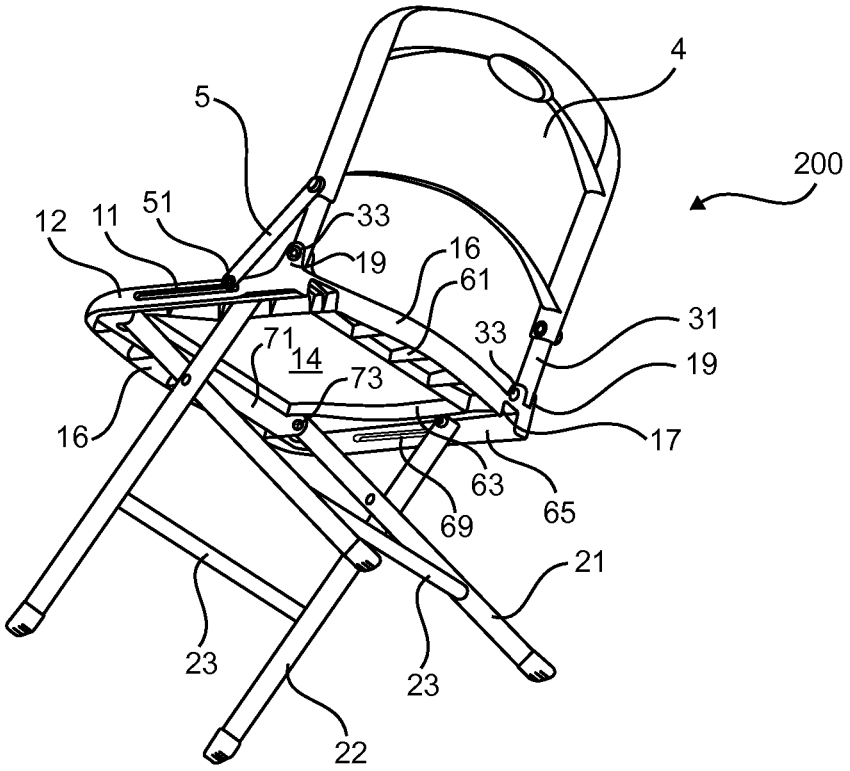
FIG. 12 is a bottom perspective view of the folding chair of FIG. 9 in an open configuration.

Referring again to FIGS. 9-13, the folding chair 200 includes a coupling member 19 extending from each side of the seat top portion 13. Each coupling member 19 includes a wall extending upwardly from the side portion 12 and an opposing wall extending from the top portion 13. In this embodiment, the lower ends of the backrest support members 31 are pivotally connected to the coupling members 19 by a fastener 33 such as a screw, rivet or nut and bolt combination. The upper ends of each support brace 5 are pivotally connected to an outer side of the backrest support members 31. Referring to FIG. 11, in the folded configuration, the backrest 4, seat 1, and leg assembly 2 overlap, while the legs 21, 22 and side portions 12 are co-planar.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

The invention claimed is:

1. A folding chair configurable into an open configuration and a folded configuration, the folding chair comprising:

a seat comprising: opposing top and bottom portions, and a pair of opposing side portions extending substantially normal to and downward from the bottom portion, each side portion having an outer slot extending between a front end and a rear end of the seat;

a pair of guiding members each connected to the seat bottom portion adjacent each side portion, an inner slot extending between a front end and rear end of the guiding member, the inner slot and outer slot substantially aligned with each other;

a front support member connected to the seat bottom portion proximate the seat front end, the front support member having a pair of rearwardly extending bracket members, each bracket member disposed proximate opposing ends of the front support member;

a leg assembly comprising: a front leg frame having a pair of front legs spaced apart substantially parallel to each other and a rear leg frame having a pair of rear legs spaced apart substantially parallel to each other, the rear leg frame having a width narrower than the front leg frame such that each rear leg is positioned between the opposing front legs adjacent to a corresponding front leg, the adjacent front and rear legs pivotally coupled to each other intermediate respective upper and lower ends, upper ends of each rear leg pivotally coupled to a corresponding bracket member of the front support member;

a backrest frame comprising a pair of spaced apart backrest support members substantially parallel to each other, the backrest frame being separate and independent from the leg assembly, an upwardly extending backrest coupled to upper portions of the backrest support members, lower ends of each backrest support member pivotally coupled to a seat side portion; and a pair of support braces, upper ends of each support brace pivotally coupled to a corresponding backrest support member and opposing lower ends of each support brace directly pivotally coupled to an upper end of a corresponding front leg by a sliding member, the sliding member extending through corresponding inner and outer slots and slidable therein;

wherein in the open configuration the backrest is substantially upright and positioned substantially perpendicular to the seat, and each sliding member engages a rear end of a corresponding inner and outer slot such that the front leg frame forms an X-shape with respect to the rear leg frame, and wherein in the folded configuration each sliding member engages a front end of a corresponding aligned inner and outer slot, the backrest is pivoted toward and overlaps the seat, the front and rear leg frames are pivoted toward each other to a substantially parallel arrangement, and the lower end of the backrest and the rear end of the seat are pivoted toward lower portions of the front and rear leg frames such that the backrest, seat and leg frames are overlapped.

2. A folding chair configurable into an open configuration and a folded configuration, the folding chair comprising:

a seat comprising: opposing top and bottom portions, and a pair of opposing side portions extending substantially normal to and downward from the bottom portion, each side portion having an outer slot extending between a front end and a rear end of the seat;

a leg assembly comprising: a front leg frame having a pair of front legs spaced apart substantially parallel to each other and a rear leg frame having a pair of rear legs spaced apart substantially parallel to each other, the adjacent front and rear legs pivotally coupled to each other intermediate respective upper and lower ends;

a backrest frame comprising a pair of spaced apart backrest support members substantially parallel to each other, lower ends of each backrest support member pivotally coupled to a rear portion of the seat, a backrest connected to top portions of the backrest support members; and a pair of support braces, upper ends of each support brace pivotally coupled to a corresponding backrest support member and opposing lower ends of each support brace directly pivotally coupled to an upper end of a corresponding front leg by a sliding member, the sliding member extending through a corresponding outer slot and slidable therein;

wherein in the open configuration the backrest frame is substantially upright and positioned substantially perpendicular to the seat, and each sliding member engages a rear end of a corresponding outer slot such that the front leg frame forms an X-shape with respect to the rear leg frame, and wherein in a folded configuration the backrest pivots toward the seat simultaneously while the front and rear leg frames are pivoted toward each other to a substantially parallel arrangement, and each sliding member slides toward a front end of a corresponding outer slot such that the backrest, seat and front and rear leg frames are overlapped.

3. The folding chair of claim 2, further comprising a pair of guiding members each connected to the seat bottom portion adjacent each side portion, each guiding member having an inner slot, the inner slot and outer slot being substantially aligned with each other, wherein the sliding members extend through corresponding inner and outer slots.

4. The folding chair of claim 2, further comprising a front support member connected to the seat bottom portion proximate the seat front end, the front support member having a pair of bracket members extending toward a rear end of the seat, each bracket member disposed proximate opposing ends of the front support member, wherein upper ends of each rear leg are pivotally coupled to a corresponding bracket member of the front support member.

5. The folding chair of claim 2, wherein the rear leg frame has a width narrower than the front leg frame such that each rear leg is positioned between the opposing front legs adjacent to a corresponding front leg

6. The folding chair of claim 2, further comprising a plurality of reinforcement ridges formed on the bottom surface of the seat.

7. The folding chair of claim 6, further comprising a pair of outer channels on the bottom portion of the seat, each channel formed between the seat side portion and one of the plurality of reinforcement ridges, each channel configured to receive adjacent front and rear legs when in folding chair is in the folded configuration.

8. The folding chair of claim 2, wherein lower ends of each backrest support member are pivotally coupled to the seat side portion.

9. The folding chair of claim 2, wherein an upper end of each support brace is coupled to an inner portion of a corresponding backrest support member.

10. The folding chair of claim 2, wherein in the folded configuration the backrest frame, support braces, seat side portions, front legs and rear legs are positioned co-planar to each other.

11. The folding chair of claim 2, wherein the rear end of each seat side portion comprises an upwardly extending coupling member, each lower end of the backrest support member pivotally coupled to each coupling member.

12. A folding chair comprising:

a seat comprising opposing top and bottom portions, and a front end and a rear end;

a leg assembly comprising: a front leg frame having a pair of front legs spaced apart substantially parallel to each other and a rear leg frame having a pair of rear legs spaced apart substantially parallel to each other, the front and rear leg frames pivotally coupled to each other intermediate respective upper and lower ends such that in an open configuration the front leg frame forms an X-shape with respect to the rear leg frame and in a folded configuration the front and rear leg frames are substantially co-planar, the front legs directly pivotally and slidably coupled to the seat intermediate front and rear ends of the seat, the rear legs pivotally coupled to the seat proximate a front end of the seat;

a backrest frame comprising a pair of spaced apart backrest support members substantially parallel to each other, the backrest frame separate and independent from the leg assembly, lower ends of each backrest support member pivotally coupled to the seat; and a pair of support braces, upper ends of each support brace pivotally coupled to a corresponding backrest support member and opposing lower ends of each support brace directly pivotally and slidably coupled to the seat.

13. The folding chair of claim 12, wherein the seat bottom portion comprises a pair of slots extending between the front end and the rear end of the seat.

14. The folding chair of claim 13, wherein a corresponding front leg upper end and support brace lower end are collectively pivotally coupled to the seat by a sliding member, each sliding member extending through a corresponding slot and slidably engaged thereto.

15. The folding chair of claim 12, further comprising opposing side portions extending substantially normal to and downward from the seat bottom portion, wherein each slot is formed on a corresponding side portion.

16. The folding chair of claim 15, wherein lower ends of each backrest support member are pivotally coupled to each seat side portion.

17. The folding chair of claim 15, wherein the rear end of each seat side portion comprises an upwardly extending coupling member, each lower end of the backrest support member being pivotally coupled to the coupling member.

18. The folding chair of claim 12, wherein the backrest frame pivots toward the seat simultaneously while the front and rear leg frames are pivoted toward each other to a substantially parallel arrangement such that the backrest frame, seat and front and rear leg frames are overlapped into a folded configuration.

19. The folding chair of claim 12, wherein an upper end of each support brace is coupled to an inner portion of a corresponding backrest support member.

20. The folding chair of claim 19, wherein in a folded configuration the backrest frame, seat side portion, front legs and rear legs are positioned co-planar to each other.

* * * * *